United States Patent [19]

Crivaro et al.

[11] Patent Number: 4,614,063

[45] Date of Patent: Sep. 30, 1986

[54] APPARATUS FOR FINISHING SURFACES

[76] Inventors: Roger P. Crivaro, R.D. #2, Box 454C, Greensburg, Pa. 15601; Ronald G. McHenry, 5237 Sadelpack Trail, Murrysville, Pa. 15668; Ronald M. McHenry, 2713 Food Ave., Pittsburgh, Pa. 15235

[21] Appl. No.: 720,545

[22] Filed: Apr. 8, 1985

[51] Int. Cl.[4] ..... B24B 7/18

[52] U.S. Cl. ..... 51/174; 51/241 S; 51/283 R

[58] Field of Search ..... 51/174, 175, 177, 166 R, 51/166 TS, 54, 56 R, 57, 59 R, 281 R, 283 R, 241 S; 125/2, 3, 25

[56] References Cited

U.S. PATENT DOCUMENTS 800962 10/1905 Wattles ..... 51/241 S 2,629,210 2/1953 Robinson ..... 51/177

2,765,597 10/1956 Ditto ..... 51/241 S 3,275,048 9/1966 Statler et al. ..... 51/175

*Primary Examiner*—Roscoe V. Parker

*Attorney, Agent, or Firm*—Jon M. Lewis

[57] ABSTRACT

A grinding apparatus and leveling process utilizing the grinding apparatus for the leveling of concrete and other masonry surface are provided. The invention particularly relates to leveling and smoothing the surfaces of foundations in preparation for the installation of industrial equipment and machinery. Specifically, a support base and a vertically height adjustable leveling base which sets atop the support base when the apparatus is in use, are provided. Mounted to the leveling base is, preferably, a power driven grinding mechanism fixed at a set vertical position relative to the leveling base.

13 Claims, 5 Drawing Figures

APPARATUS FOR FINISHING SURFACES

FIELD OF INVENTION

This invention relates to an apparatus for finishing surfaces, and more specifically, to an apparatus for the preparation of concrete surfaces that provides foundational support for equipment.

BACKGROUND OF THE INVENTION

In the installation of machinery and equipment, and especially in the installation of heavy machinery and equipment, concrete or other masonry substances are used to provide foundational support for the machine. It is often of utmost importance that the surface of the foundation provide a smooth and level surface for the areas of transition between the foundation and the machine, in order to prevent damaging or excessive vibratory motion while the machine is in use. In addition to possibly damaging the machine and foundation, excessive vibratory motions may also result in, for example, the translocation of the machine thereby further worsening performance, the production of products falling short of specifications, the malfunctioning of a system of which the machine is an integral part, the creation of structural defects in situations where the machine provides structural integrity, and the creation of a state of imbalance wherein the machine is in danger of becoming upended.

The surfaces of masonry foundations have conventionally been prepared by hand bushing the surface. Areas of the foundation are made smooth and level by using either a hammer and chisel or a hammer with a serrated end (bushing hammer). In general, this requires that the surface alternately be hand bushed and the degree of levelness and smoothness checked until the surface is sufficiently smooth and level. While simple in theory, this process can be very time consuming and costly. After the surface is made smooth and level, the machine is then installed, preferably utilizing shims disposed between the foundation and the machine. Supplementary to the quality and economic aspects of equipment and machinery installation, most manufacturers of quality industrial equipment specify a minimum degree of contact between the equipment or shims and the foundation. Minimum levels as high as 80% are often specified. Such high levels of contact may be extremely difficult and expensive, if not impossible, to obtain.

Apparatuses have been provided in the past for grinding, finishing and dressing surfaces. These and other apparatuses generally either do not provide leveling mechanisms integrated as part of such apparatus or are not otherwise ideally suited to the preparation and grinding of masonry surfaces of sufficient quality for industrial equipment installation.

It is therefore an object of this invention to provide an apparatus to be used in conjunction with a power driven grinding mechanism for grinding masonry surfaces sufficiently smooth and level so as to provide for high degrees of contact between the masonry surface and equipment mounted onto said surface.

It is also an object to provide an apparatus used in conjunction with a power driven grinding mechanism for grinding masonry which provides smooth, level surfaces at a reduction of time, manpower and expense relative to conventional processes utilized in the area of machine installation.

SUMMARY OF INVENTION

It has been found that the objects identified above are met by the present invention. Accordingly, the present invention contemplates using a power driven grinding mechanism which is mounted between a pair of rails in such a way that the grinding mechanism may be horizontally moved, but not vertically moved, in a direction parallel to the rails. The remaining elements of the apparatus provide a unique and highly efficient means ideal for grinding masonry surfaces smooth and level. It should be realized, of course, that the present invention can also be effectively applied to other grinding and surface treating processes, and such applications shall not be construed to fall outside the scope of this invention.

More specifically regarding the apparatus, a novel means for leveling the grinding apparatus is provided. The grinding mechanism is supported by and disposed within the confines of a frame like leveling base. The leveling base rests on a support base which is preferably of the same shape and dimensions as the leveling base. Leg members of the support base contact the surface which is to be treated. Means are provided for contemporaneously supporting the leveling base on the support base at a plurality of points and which enable the vertical height of the leveling base to be adjusted as desired. In the preferred embodiment, a plurality of bolts vertically extending through the leveling base are utilized as support and adjustment means. Other support and adjustment means within the scope of this invention will be known or apparent to those skilled in the art. The bolts are of conventional design, having a rod portion and, at one end, a handle. The handle end is positioned above the leveling base. The other end, consequently, extends through the leveling base and contacts the support base. By rotating the bolts, the vertical height of the leveling base can be independently adjusted at each of the plurality of support points. By strategically adjusting the leveling base height by rotating the bolts, the grinding mechanism can be positioned such that a high quality, flat, smooth horizontal surface may be ground. Since the bolts are inherently infinitely adjustable, this enables a high degree of accuracy to be obtained. Thus, high manufacturer specification which previously were difficult to obtain can be more easily and quickly achieved.

Our invention provides a foundation surface that gives a relatively high degree of contact between a machine to be installed on shims in an economical, relatively quick manner. The hand methods are not effective to provide the relatively greater shim to foundation contact as our invention.

Optionally, level indicators may be integrated into the leveling base in order to aid an operator to strategically manipulate the bolts. Also optionally, weights may be placed in the apparatus, preferably on the leveling base, in order to reduce vibrations and to ensure that the leveling base and leveling support is firmly situated.

DETAILED DESCRIPTION OF THE PREFERRED EMBODIMENT

Figure 1:
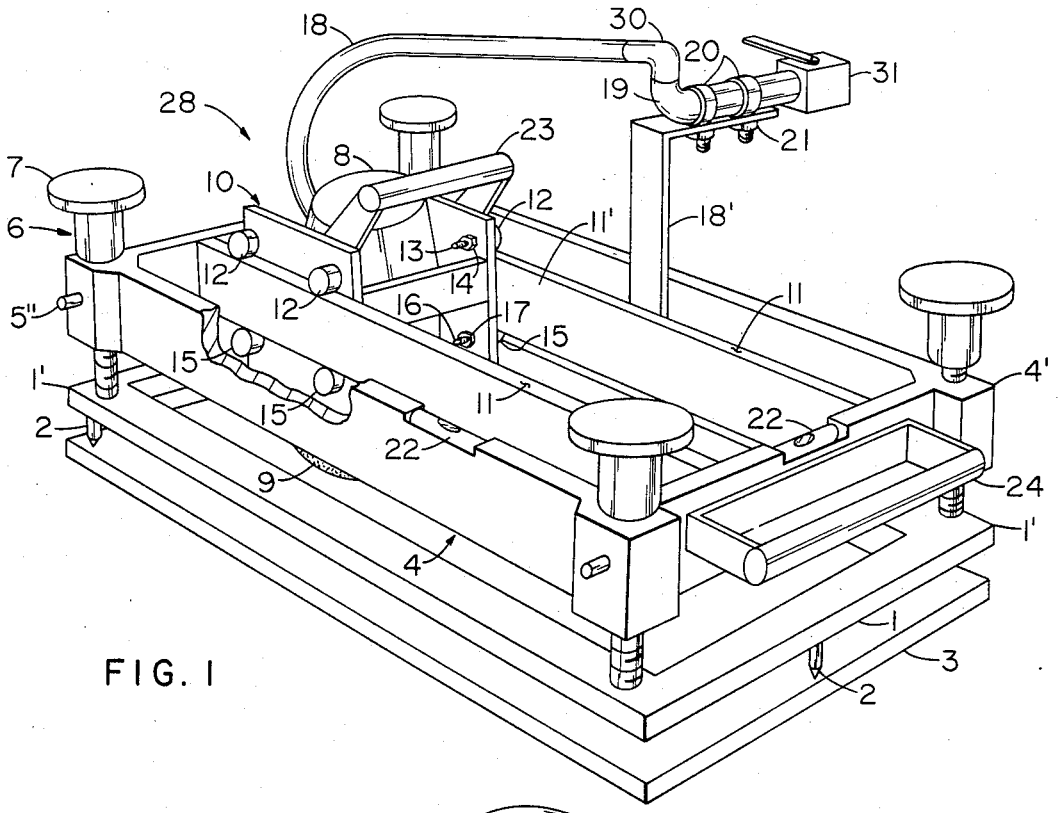
FIG. 1 is a side view of a grinding apparatus.
Figure 2:
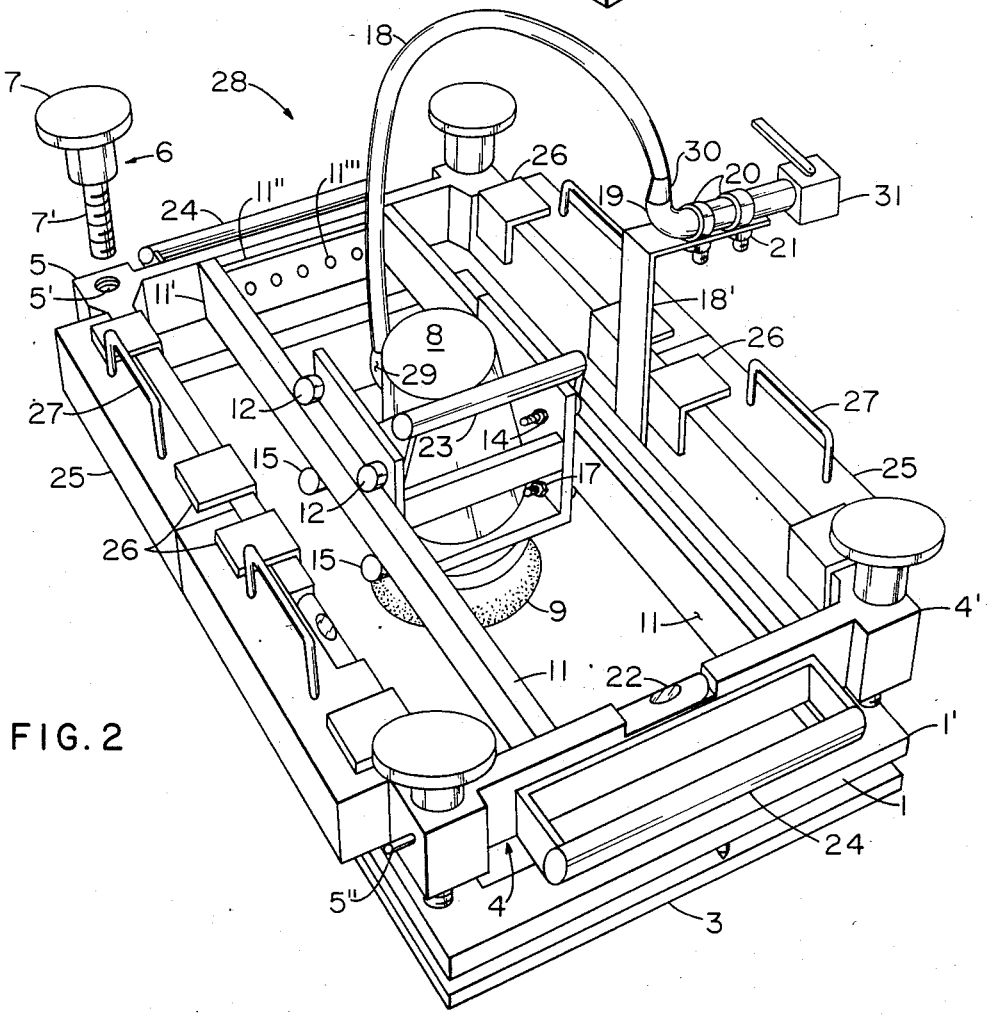
FIG. 2 is a top, angular view of a grinding apparatus.

Referring to FIGS. 1 and 2, shown is a grinding apparatus 28. The apparatus 28 has a metal, rectangular support base 1 which has three support base leg members 2 which contact a surface to be ground when the apparatus is in use. A rectangular, metal leveling base 4 is set on the support base 1. The leveling base 4 is of similar dimensions as the support base 1. In the preferred embodiment, the rectangular leveling and support bases 4, 1 each have four corners 4', 1'. A cylindrical, vertical socket 5 having a grooved interior 5' is provided at each leveling base corner 4'. A rotatable leveling bolt 6 extends through each socket 5. Each bolt 6 has a handle 7 and a grooved rod portion 7'. The groved rod portion 7' contacts the support base 1 at the corresponding support base corner 1'. Socket valves 5" are provided for each socket 5. It is desirable to lubricate the socket 5 and/or the bolt 6 to ease rotation and prevent corrosion. The purpose of the socket valves 5" is to allow drainage of excessive lubricant from the socket 5.

Figure 3:
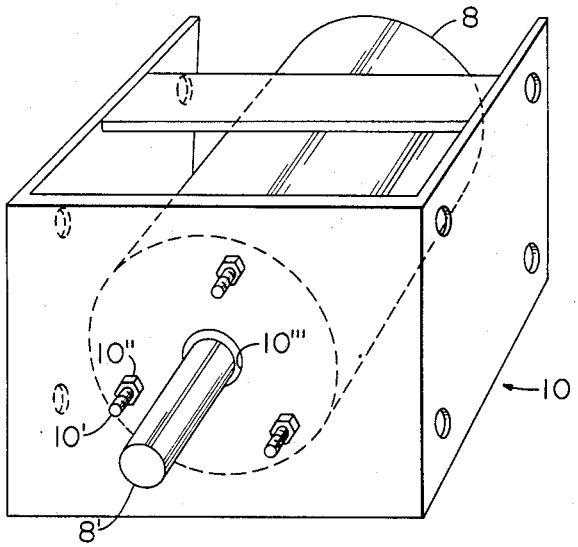
FIG. 3 is a bottom view of a grinding mechanism and a grinding mechanism carriage.
Figure 4:
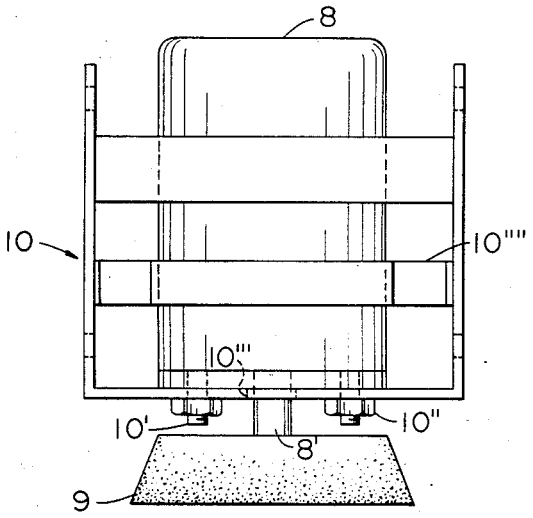
FIG. 4 is a side view of a grinding mechanism, a grinding mechanism carriage and a grinding element.
Figure 5:
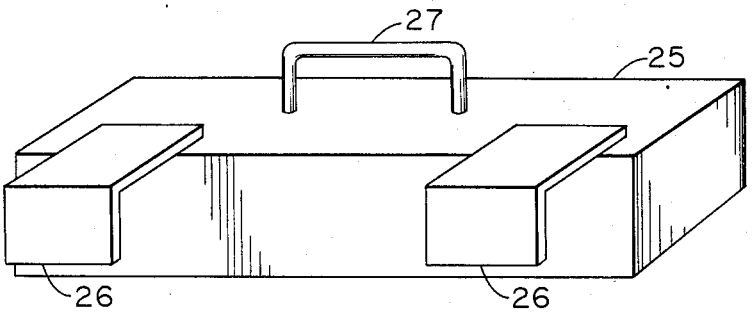
FIG. 5 shows a counter weight.

Referring to FIGS. 3 and 4, a power driven grinding mechanism 8 is shown. The particular grinding mechanism shown is air driven. The grinding mechanism 8 is disposed within a carriage 10 having a carriage handle 23. The grinding mechanism 8 is securely bolted to the carriage 10 with attaching bolts 10' and attaching nuts 10". A grinding element 9 is rotatably connected to the grinding mechanism 8 by an axle 8'. An orifice 10" is provided, through which the axle 8' passes. A brace 10"" provides additional support for the grinding mechanism 8.

Referring back to FIGS. 1 and 2, it can be seen that a pair of parallel carriage rails 11 are provided. In the preferred embodiment, the carriage rails 11 are integrated as members of a one piece rectangular frame 11'. Perpendicular to the carriage rails 11 and parallel to each other are a pair of connector members 11", which are also part of the rectangular frame 11'. The frame 11' is securely connected the leveling base 4 by bolt means 11"".

The carriage 10 is slidably connected to each of the carriage rails 11 with upper cylindrical bearings 12 and lower cylindrical bearings 15 such that vertical movement of the carriage independent of the carriage rails is prevented. The upper bearings 12 are rotatably connected to the carriage 10 by an upper bearing axle 13 and an upper bearing nut 14. The lower bearing 15 are similarly connected to the carriage 10 by a lower bearing axle 16 and a lower bearing nut 17.

An air hose 18 with swiveling connection at each end extends from the grinding mechanism 8 and is connected to a hollow, air hose elbow 19, which is in turn attached to a shut off ball valve, an air hose support 18' with U-shaped rods 20 and U-shaped rod nuts 21. The air hose support 18' is a convenience and safety feature which ensures that the air hose 18 does not become entangled during the operation of the apparatus 28.

Level indicators 22 are attached to the leveling base 4. The level indicators 22 facilitate an operator of the apparatus 28 to continuously monitor progress while adjusting the vertical height of the leveling base 4 by rotating the leveling bolts 6. Preferably, a level indicator 22 is provided between each vertical heights adjustment means, which in the preferred embodiment, are the leveling bolts 6.

An additional feature which is particularly useful for the grinding of masonry is a means for increasing the mass of the apparatus 28. Such means reduces the amount of downward force which must be supplied by the operator to ensure that the support base legs 1' remain in contact with the surface 3 during grinding.

Referring to FIGS. 1 and 4, leveling base weights 25 are detachably connected to the leveling base 4. Each leveling base weight 25 has leveling base weight supports 26 which are designed to fit onto the level base 4. Leveling base weight handles 27 are provided for convenience. Leveling base handles 24 securely connected to the leveling base 4 are also provided to facilitate mobility of the leveling base 4 and carriage rail 11 assembly.

It should be pointed out that it may be necessary to adjust the carriage rails 11 to increase or decrease their length to provide for different patterns and sizes; therefore, although not shown, they may be adjustibly connected within the rectangular frame 11' or different size frames could be provided.

The following procedure is recommended for operation of the present invention in connection with the installation of machinery. First, the foundation is prepared for grinding by using a pneumatic bushing hammer to relieve a path at least as wide as the shim which is to be used in connection with installation of the machine, Preferably, the path is approximately $\frac{1}{4}$" deep and $\frac{1}{2}$" to 1" larger to in horizontal dimensions than the shim. The support base is placed over the area to be ground. The leveling base and grinder mechanism are then placed on the support base; and, by rotating the leveling bolts and monitoring the level indicators, the leveling base is leveled at a vertical height at which the grinding element is slightly higher than the surface. The grinding mechanism is switched on. The operator(s) slowly lower the grinding mechanism by rotating the leveling bolts while maintaining the leveling base in a level condition. Lowering of the grinding mechanism is stopped when the entire surface area of the grinding element is in contact with the surface. The carriage may be slid along the carriage rails to a precise, predetermined spot or to enlarge the area of grinding. During grinding, a small but constant flow of water should be maintained over the surface which is being ground.

While the foregoing description describes the preferred embodiments of the present invention, said description is not meant to limit the scope of the invention. Accordingly, reference should be made to the claims in determining the scope of the invention.

We claim:

1. An apparatus for use in combination with a power driven grinding mechanism, comprising:
   a. a support base having a framed-like structure enclosing an interior portion;
   b. a leveling base disposed above the support base having a vertically height-adjustable means for supporting said leveling base on said support base, said leveling base having a frame like structure enclosing an interior portion; and
   c. means for supporting a grinding mechanism within the interior portion of the leveling base at a fixed vertical position relative to the leveling base.

2. An apparatus of claim 1, wherein said vertically height-adjustable support means comprises:

a. a plurality of vertical, grooved sockets located in the leveling base; and b. a plurality of leveling bolts, of a number coinciding with said plurality of sockets, each leveling bolt having a grooved rod portion and handle, wherein the rod portions of said leveling bolts are rotatably disposed within said sockets when the apparatus is in use and whereby said rod portions are in contact with the support base when the apparatus is in use.

3. An apparatus of claim 1, wherein said means for supporting the grinding mechanism comprises:

a. a pair of parallel rails connected to and extending within the leveling base; and b. means for slidably mounting the grinding mechanism onto the parallel rails.

4. An apparatus of claim 3, wherein said mounting means comprises a carriage having a plurality of rotatable bearings disposed above and in contact with each rail and a plurality of rotatable bearings disposed below and in contact with each rail.

5. An apparatus of claim 1 further comprising at least one detachable weight detachably attached to the apparatus.

6. An apparatus of claim 5, wherein said weight is detachably attached to the leveling base.

7. An apparatus as in claim 1 further comprising at least one level indicator connected to the leveling base.

8. An apparatus as in claim 2 further comprising at least one level indicator connected to the leveling base between all adjacent leveling bolts.

9. An apparatus as in claim 2 wherein said leveling base and said support base are rectangular in shape, each base having four corners, wherein said leveling bases have four sockets, one socket being located at each corner, and wherein said apparatus has four leveling bolts disposed with said sockets and in contact with said support base.

10. A process for leveling the surface of masonry foundations with a power driven grinding mechanism, said mechanism having a grinding element, said process comprising the steps of:

a. placing a support base on the foundation;

b. placing a leveling base having vertically height adjustable support means on said support base; said leveling base having a grinding mechanism mounted within it at a fixed vertical position relative to said leveling base;

c. adjusting the leveling base to a level position; such that the grinding element is positioned above an uppermost surface of the foundation;

d. directing a source of power to the grinding mechanism; and e. lowering the leveling base and grinding element until the grinding element is in full contact with the surface of the foundation while simultaneously maintaining the leveling base in a substantially level condition.

11. A process as in claim 10 wherein said vertically adjustable support means comprises a plurality of grooved bolts rotatably disposed through vertical grooved sockets located in the leveling base, such that said bolts contact the support base when so as to support the leveling base on said support base, wherein the steps of adjusting the leveling base at a level position and lowering the leveling base while maintaining a substantially level condition are performed by strategically rotating said bolts.

12. A process as in claim 10 further comprising the step of directing a flow of water over the surface of the foundation when said grinding is in contact with the surface of the foundation.

13. A process as in claim 10 further comprising the step of pre-treating the surface with a bushing tool.

* * * * *